US008640386B1

(12) United States Patent
Griffith et al.

(10) Patent No.: US 8,640,386 B1
(45) Date of Patent: Feb. 4, 2014

(54) STIFFENING OF AN AIR BEAM

(71) Applicant: Other Lab, LLC, San Francisco, CA (US)

(72) Inventors: Saul Griffith, San Francisco, CA (US); Peter S. Lynn, Oakland, CA (US)

(73) Assignee: Other Lab, LLC, San Francisco, CA (US)

( * ) Notice: Subject to any disclaimer, the term of this patent is extended or adjusted under 35 U.S.C. 154(b) by 0 days.

(21) Appl. No.: 13/662,305

(22) Filed: Oct. 26, 2012

Related U.S. Application Data

(60) Provisional application No. 61/553,076, filed on Oct. 28, 2011.

(51) Int. Cl.
*E04H 15/20* (2006.01)
*E04C 3/28* (2006.01)

(52) U.S. Cl.
USPC ..... 52/2.11

(58) Field of Classification Search
USPC ..... 52/2.11, 2.13, 2.16, 2.21, 843
See application file for complete search history.

(56) References Cited

U.S. PATENT DOCUMENTS

| | | | | |
|---|---|---|---|---|
| 2,936,056 | A * | 5/1960 | Heyniger | 193/25 B |
| 5,311,706 | A * | 5/1994 | Sallee | 52/2.18 |
| 5,579,609 | A * | 12/1996 | Sallee | 52/2.11 |
| 6,108,980 | A * | 8/2000 | Braun | 52/2.16 |
| 6,463,699 | B1 * | 10/2002 | Bailey et al. | 52/2.11 |
| 8,191,819 | B2 * | 6/2012 | Luchsinger | 244/30 |
| 2002/0157322 | A1 * | 10/2002 | Pedretti | 52/2.13 |
| 2006/0260209 | A1 * | 11/2006 | Pedretti | 52/2.11 |
| 2008/0295417 | A1 * | 12/2008 | Turcot | 52/2.13 |
| 2009/0019784 | A1 * | 1/2009 | Tinker et al. | 52/2.11 |
| 2010/0163683 | A1 * | 7/2010 | Quine | 244/158.5 |
| 2011/0209416 | A1 * | 9/2011 | Pedretti | 52/2.11 |

* cited by examiner

*Primary Examiner* — Christine T Cajilig
(74) *Attorney, Agent, or Firm* — Van Pelt, Yi & James LLP

(57) ABSTRACT

Stiffening of an air beam uses an apparatus. The apparatus comprises a high pressure inflatable structure and an inflatable beam structure. The high pressure inflatable structure is inflated causing a first internal pressure. The inflatable beam structure is inflated causes a second internal pressure. The inflatable beam structure is reinforced against bending with the high pressure inflatable structure. The first internal pressure is greater than the second internal pressure.

20 Claims, 2 Drawing Sheets

STIFFENING OF AN AIR BEAM

CROSS REFERENCE TO OTHER APPLICATIONS

This application claims priority to U.S. Provisional Patent Application No. 61/553,076 entitled SYSTEMS FOR PNEUBOTICS AND EXODERMIS PROSTHETICS filed Oct. 28, 2011 which is incorporated herein by reference for all purposes.

BACKGROUND OF THE INVENTION

The concept of tensairity involves attaching a thin compressive member along the compressive side of an inflated tube which is loaded in bending. The inflated tube prevents the thin compressive member from buckling, enabling a very high strength and lightweight structure. One of the draw backs of tensairity structures is that a compressive member is included in the structure that can constrain packing and cause a rigid hard point in the structure.

BRIEF DESCRIPTION OF THE DRAWINGS

Various embodiments of the invention are disclosed in the following detailed description and the accompanying drawings.

DETAILED DESCRIPTION

Figure 1A:
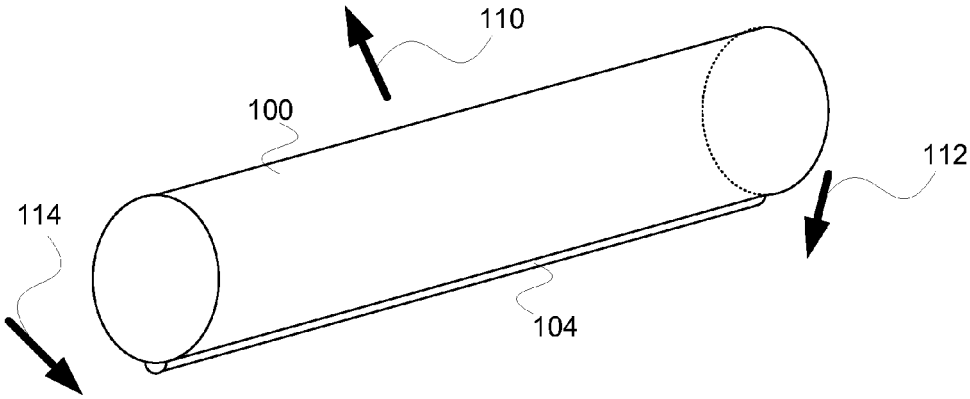
FIG. 1A is a diagram illustrating an embodiment of an inflatable beam structure using a high pressure inflatable structure.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Stiffening of an air beam is disclosed. An apparatus comprises a high pressure inflatable structure and an inflatable beam structure. The high pressure inflatable structure is inflated causing a first internal pressure. The inflatable beam structure is inflated causes a second internal pressure. The inflatable beam structure is reinforced against bending with the high pressure inflatable structure. The first internal pressure is greater than the second internal pressure.

Air-air-ity, as we have now termed it, involves replacing a compressive rigid element with a small high pressure tube. This enables many of the benefits of tensairity while still retaining the benefits of a fully inflatable structure. An extreme variant of this is to encase a low pressure volume with a surface layer of high pressure tubes. This can enable the construction of very light weight bodies or structures. Structurally this is closely related to a foam core composite construction, as often is used in aerospace. It is in effect the inflatable variant of foam core construction.

The high pressure surface construction approach can also be applied to inflatable actuator design. It enables high pressure actuation of large low pressure inflatable structures. High pressure actuation can enable the use of small, efficient and lightweight hydraulic systems, that might, for example, use water. This is notable because:

- it enables tensairity type design using fully inflatable structures.
- it enables fully integrated tensairity type surface structures.
- it enables high pressure low volume inflatable actuators on low pressure high volume structures.

The basic principle is to attach a small high pressure tube to the surface of a large low pressure volume so as to constrain it and prevent it from buckling. In this way the full compressive strength of the small high pressure tube can be utilized by the larger lower pressure inflated structure. This is a standard tensairity technique using a small high pressure tube instead of a say small diameter flexible carbon fiber rod.

- The small high pressure compressive element still allows for inflatable like packing, unlike if using a small diameter carbon fiber rod.
- Small high pressure tube can utilize high strength composite materials.
- Air-airity allows for the addition of compressive inflatable structure to the surfaces of large low pressure structures where it is desired.
- These high pressure tubes can be actuated, enabling the actuation and controlled deformation of large low pressure inflatable structure with a low flow rate high pressure fluid. This can be thought of as a mechanical gearing system.

FIG. 1A is a diagram illustrating an embodiment of an inflatable beam structure using a high pressure inflatable structure. In the example shown, inflatable beam the high pressure inflatable structure comprises one or more internally pressurized high pressure cells 100 is reinforced using high pressure inflatable structure 104. High pressure inflatable structure 104 resists bending of inflatable beam structure 100 due to, for example, force 110, force 112, and force 114. In various embodiments, high pressure inflatable structure 104 comprises a high strength fiber outer shell with a fluid sealing inner layer. In various embodiments, the high strength fiber comprises polyester, nylon, laminated combinations of polyester and polyethylene fiber such as Cuben™ Fiber, Aromatic polyesters (e.g., Vectran™), Ultra heavy molecular weight polyethylene (e.g., Spectra™, Dyneema®, etc.), Aramids (e.g., Kevlar®, Technora™, Twaron™), thermoset polyurethanes (e.g., Zylon™), polyethylene terephthalate (PET) (e.g., Dacron™, Diolen™, Terylene™, Trevira™ —Polyesters), polyethylene naphthalate (PEN) (e.g., Pentex™), carbon fibers, and/or glass fibers, or any other appropriate fibers. The pressure inside inflatable beam structure 100 is lower than the pressure inside high pressure inflatable structure 104. High pressure inflatable structure 104 is constrained in its position relative to inflatable beam structure 100 by a sheath sown onto inflatable beam structure 100. In various embodiments, High pressure inflatable structure 104 is constrained using loops, a plurality of sheaths, adjustable screw threads, a holding cup, or using any other appropriate manner of constraining.

Figure 1B:
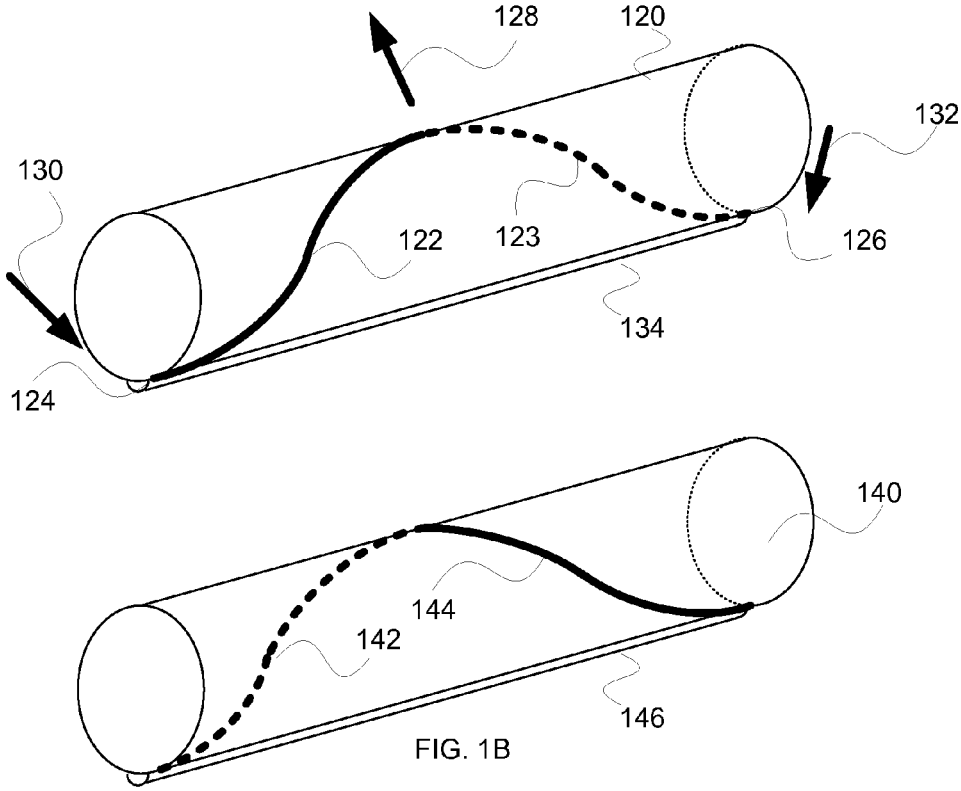
FIG. 1B is a diagram illustrating embodiments of an inflatable beam using a high pressure inflatable structure and using a tension reinforcement element.

FIG. 1B is a diagram illustrating embodiments of an inflatable beam using a high pressure inflatable structure and using a tension reinforcement element. In the example shown, inflatable beam structure 120 is reinforced using high pressure inflatable structure 134 tension reinforcement element comprising element 122, which lies on the front surface of inflatable beam structure 120, and element 123, which continues on the back surface of inflatable beam structure 120. The tension reinforcement element wraps around the internal pressurized beam. Tension reinforcement element, which is comprised of element 122 and element 123, resists bending of inflatable beam structure 120 (e.g., due to a combination of forces in direction 130, in direction 132, and in direction 128). In various embodiments, tension reinforcement element comprises a high strength fiber or group of fibers, a reinforcement of the material of the internal pressurized beam, the material of the internal pressurized beam, where the material is oriented to have high strength required to tension reinforce the internal pressurized beam (e.g., using a material property, braid, or laminate), or any other appropriate tension reinforcement. In various embodiments, a tension reinforcement element is comprised of high strength fibers (e.g., Aromatic polyesters (Vectran™), Ultra heavy molecular weight polyethylene (Spectra, Dyneema®, etc.), Aramids (Kevlar®, Technora, Twaron), thermoset polyurethanes (Zylon), PET (Dacron, Diolen, Terylene, Trevira—Polyesters), PEN (Pentex), carbon fibers, and/or glass fibers), or any other appropriate fibers. Tension reinforcement element is anchored at position 124 and position 126. Tension reinforcement element is held in its position relative to inflatable beam structure 120 by being integral or integrated into the material. In various embodiments, tension reinforcement element is constrained using loops, one or more sheaths, is braided or woven into the skin of the internal pressurized beam in production, or using any other appropriate manner of constraining.

In some embodiments, an additional reinforcement element is used. Inflatable beam 140 is reinforced using tension reinforcement element comprising element 144, which lies on the front surface of inflatable beam 140, and element 142, which continues on the back surface of internal pressurized beam 140. Tension reinforcement element, which is comprised of element 142 and element 144, resists bending of inflatable beam 140. In some embodiments, two tension reinforcement elements (e.g., such as those illustrated for inflatable beam structure 120 and inflatable beam 140) reinforce a single internal pressurized beam.

Figure 2:
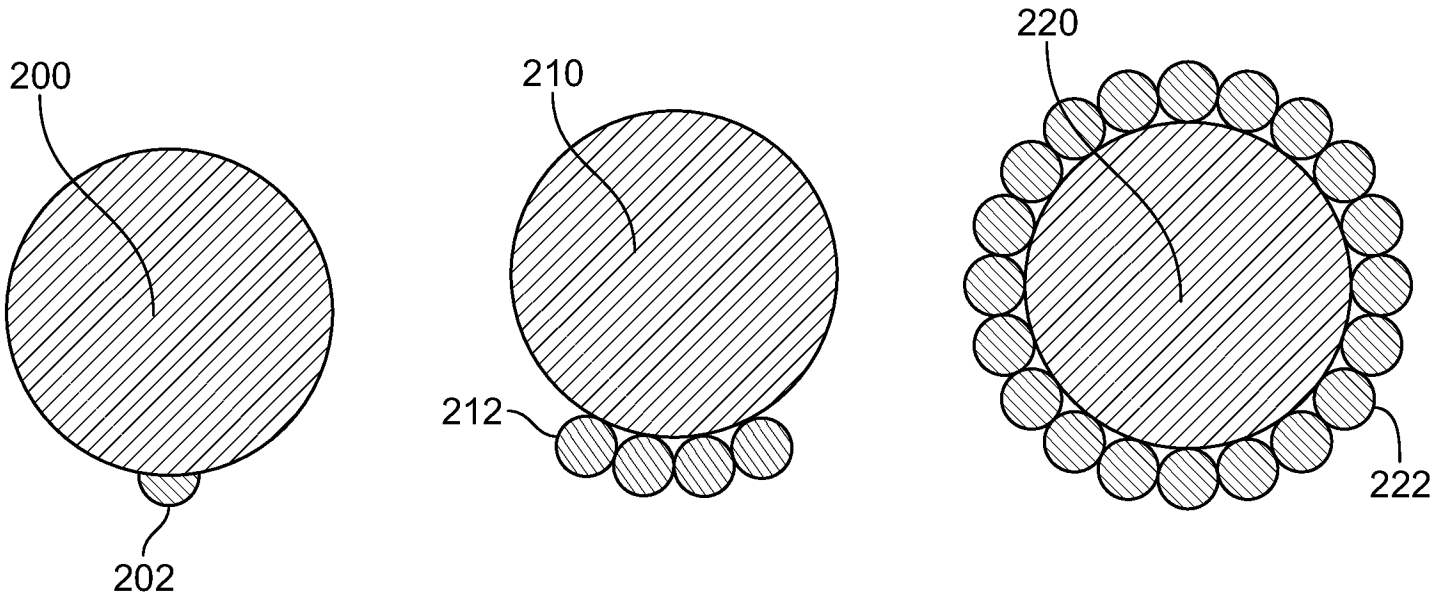
FIG. 2 is a diagram illustrating embodiments of an inflatable beam cross section.

FIG. 2 is a diagram illustrating embodiments of an inflatable beam cross section. In the examples shown, inflatable beam 200 has high pressure inflatable structure 202. Inflatable beam 210 has a plurality of high pressure inflatable structures 212. Inflatable beam 220 has high pressure inflatable structures 222 all around the periphery.

In some embodiments, the inflatable beam structure is a part of one or more of the following: an inflatable structure of a robot, an inflatable structure of a building, an inflatable structure for civil engineering structures, an inflatable structure for automotive systems, an inflatable structure for architectural systems, or an inflatable structure for aerospace systems.

In some embodiments, the inflatable beam comprises one or more internally pressurized cells. In some embodiments, the high pressure inflatable structure comprises one or more internally pressurized high pressure cells.

In various embodiments, the inflatable beam structure is comprised of a material, wherein the material is one or more of the following: polyester, silicon coated materials, nylon, laminated combinations of polyester and polyethylene fiber such as Cuben Fibe™, Vectran™, or any other appropriate material. In various embodiments, the high pressure inflatable structure is comprised of a material, wherein the material is one or more of the following: polyester, silicon coated materials, nylon, Cuben Fiber™, Vectran™, or any other appropriate material.

In some embodiments, a tension reinforcement element wraps around the inflatable beam structure.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An apparatus, comprising:

a high pressure inflatable structure, wherein the high pressure inflatable structure is inflated causing a first internal pressure; and an inflatable beam structure, wherein the inflatable beam structure is inflated causing a second internal pressure, wherein the inflatable beam structure is reinforced against bending with the high pressure inflatable structure, and wherein the first internal pressure is greater than the second internal pressure, wherein the high pressure inflatable structure is constrained in position relative to the inflatable beam structure by a sheath sown onto the inflatable beam structure.

2. An apparatus as in claim 1, wherein the inflatable beam structure is a part of one or more of the following: an inflatable structure of a robot, an inflatable structure of a building, an inflatable structure for civil engineering structures, an inflatable structure for automotive systems, an inflatable structure for architectural systems, or an inflatable structure for aerospace systems.

3. An apparatus as in claim 1, wherein the inflatable beam structure comprises one or more internally pressurized cells.

4. An apparatus as in claim 1, wherein the high pressure inflatable structure comprises one or more internally pressurized high pressure cells.

5. An apparatus as in claim 1, wherein the high pressure inflatable structure is one of a plurality of high pressure inflatable structures.

6. An apparatus as in claim 1, wherein the plurality of high pressure inflatable structures are all around the periphery of inflatable beam structure.

7. An apparatus as in claim 1, wherein the inflatable beam structure is comprised of a material, wherein the material is one or more of the following: polyester, silicon coated materials, nylon, thermoset polyurethanes, polyethylene terephthalate, polyethylene naphthalate, carbon fibers, glass fibers, Aramids, Aromatic polyesters, or laminated combinations of polyester and polyethylene fibers.

8. An apparatus as in claim 1, wherein the high pressure inflatable structure is comprised of a material, wherein the material is one or more of the following: polyester, silicon coated materials, nylon, thermoset polyurethanes, polyethylene terephthalate, polyethylene naphthalate, carbon fibers, glass fibers, Aramids, Aromatic polyesters, or laminated combinations of polyester and polyethylene fibers.

9. An apparatus as in claim 1, wherein the high pressure inflatable structure comprises a high strength fiber outer shell with a fluid sealing inner layer.

10. An apparatus as in claim 1, further comprising a tension reinforcement element.

11. An apparatus as in claim 10, wherein the tension reinforcement element is constrained in its position relative to the inflatable beam structure using one or more of the following: a sheath, one or more loops, a plurality of sheaths, or is braided or woven into the skin of the internal pressurized beam in production.

12. An apparatus as in claim 10, wherein the tension reinforcement element wraps around the inflatable beam structure.

13. A method, comprising:

providing a high pressure inflatable structure, wherein the high pressure inflatable structure is inflated causing a first internal pressure; and providing an inflatable beam structure, wherein the inflatable beam structure is inflated causing a second internal pressure, wherein the inflatable beam structure is reinforced against bending with the high pressure inflatable structure, and wherein the first internal pressure is greater than the second internal pressure, wherein the high pressure inflatable structure is constrained in position relative to the inflatable beam structure by a sheath sown onto the inflatable beam structure.

14. A method as in claim 13, wherein the inflatable beam structure a part of one or more of the following: an inflatable structure of a robot, an inflatable structure of a building, an inflatable structure for civil engineering structures, an inflatable structure for automotive systems, an inflatable structure for architectural systems, or an inflatable structure for aerospace systems.

15. A method as in claim 13, wherein the inflatable beam structure comprises one or more internally pressurized cells.

16. A method as in claim 13, wherein the high pressure inflatable structure comprises one or more internally pressurized high pressure cells.

17. A method as in claim 13, wherein the high pressure inflatable structure is one of a plurality of high pressure inflatable structures.

18. A method as in claim 13, further comprising providing a tension reinforcement element.

19. A method as in claim 18, wherein the tension reinforcement element is constrained in its position relative to the inflatable beam structure using one or more of the following: a sheath, one or more loops, a plurality of sheaths, or is braided or woven into the skin of the internal pressurized beam in production.

20. A method as in claim 18, wherein the tension reinforcement element wraps around the inflatable beam structure.

* * * * *

UNITED STATES PATENT AND TRADEMARK OFFICE

CERTIFICATE OF CORRECTION

PATENT NO. : 8,640,386 B1
APPLICATION NO. : 13/662305
DATED : February 4, 2014
INVENTOR(S) : Saul Griffith and Peter S. Lynn It is certified that error appears in the above-identified patent and that said Letters Patent is hereby corrected as shown below:

In the Specification

In column 1, after the first paragraph, at line 10, please insert the following government rights statement:

-- GOVERNMENT RIGHTS STATEMENT

The invention was made with Government support under contract number W911QX-12-C-0096, awarded by the U.S. Army Contracting Command - Aberdeen Proving Ground (ACC-APG) for the Defense Advanced Research Projects Agency (DARPA). The Government has certain rights in the invention. --

Signed and Sealed this
Twentieth Day of October, 2015

Michelle K. Lee

Michelle K. Lee
*Director of the United States Patent and Trademark Office*